US006232859B1

(12) United States Patent
Christensen et al.

(10) Patent No.: US 6,232,859 B1
(45) Date of Patent: May 15, 2001

(54) AUXILIARY SWITCH MOUNTING CONFIGURATION FOR USE IN A MOLDED CASE CIRCUIT BREAKER

(75) Inventors: Dave S. Christensen, Harwinton; Roger N. Castonguay, Terryville; James Rosen, West Hartford, all of CT (US); Francesco DeVizzi, Milan (IT)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/525,571

(22) Filed: Mar. 15, 2000

(51) Int. Cl.[7] ..... H01H 67/02

(52) U.S. Cl. ..... 335/132; 335/202

(58) Field of Search ..... 335/6, 14, 20, 335/132, 167–171, 202; 200/293–308

(56) References Cited

U.S. PATENT DOCUMENTS

| | | |
|---|---|---|
| D. 367,265 | 2/1996 | Yamagata et al. . |
| 2,340,682 | 2/1944 | Powell . |
| 2,719,203 | 9/1955 | Gelzheiser et al. . |
| 2,937,254 | 5/1960 | Ericson . |
| 3,158,717 | 11/1964 | Jencks et al. . |
| 3,162,739 | 12/1964 | Klein et al. . |
| 3,197,582 | 7/1965 | Norden . |
| 3,307,002 | 2/1967 | Cooper . |
| 3,517,356 | 6/1970 | Hanafusa . |
| 3,631,369 | 12/1971 | Menocal . |
| 3,803,455 | 4/1974 | Willard . |
| 3,883,781 | 5/1975 | Cotton . |
| 4,129,762 | 12/1978 | Bruchet . |
| 4,144,513 | 3/1979 | Shafer et al. . |
| 4,158,119 | 6/1979 | Krakik . |
| 4,165,453 | 8/1979 | Hennemann . |
| 4,166,988 | 9/1979 | Ciarcia et al. . |
| 4,220,934 | 9/1980 | Wafer et al. . |
| 4,255,732 | 3/1981 | Wafer et al. . |
| 4,259,651 | 3/1981 | Yamat . |
| 4,263,492 | 4/1981 | Maier et al. . |
| 4,276,527 | 6/1981 | Gerbert-Gaillard et al. . |
| 4,297,663 | 10/1981 | Seymour et al. . |
| 4,301,342 | 11/1981 | Castonguay et al. . |
| 4,360,852 | 11/1982 | Gilmore . |
| 4,368,444 | 1/1983 | Preuss et al. . |
| 4,375,021 | 2/1983 | Pardini et al. . |
| 4,375,022 | 2/1983 | Daussin et al. . |
| 4,376,270 | 3/1983 | Staffen . |
| 4,383,146 | 5/1983 | Bur . |
| 4,392,036 | 7/1983 | Troebel et al. . |
| 4,393,283 | 7/1983 | Masuda . |
| 4,401,872 | 8/1983 | Boichot-Castagne et al. . |
| 4,409,573 | 10/1983 | DiMarco et al. . |
| 4,435,690 | 3/1984 | Link et al. . |
| 4,467,297 | 8/1984 | Boichot-Castagne et al. . |
| 4,468,645 | 8/1984 | Gerbert-Gaillard et al. . |
| 4,470,027 | 9/1984 | Link et al. . |

(List continued on next page.)

FOREIGN PATENT DOCUMENTS

| | | |
|---|---|---|
| 819 008 | 12/1974 | (BE) . |
| 12 27 978 | 11/1966 | (DE) . |
| 30 47 360 | 6/1982 | (DE) . |

(List continued on next page.)

*Primary Examiner*—Lincoln Donovan
(74) *Attorney, Agent, or Firm*—Cantor Colburn LLP; Carl B. Horton

(57) ABSTRACT

A molded case circuit breaker assembly using auxiliary switches to perform indication and control functions. The circuit breaker assembly having at least one pole comprising a stationary and a moveable contact where the moveable contact is connected to a moveable contact arm which is activated by a spring mechanism. The spring mechanism is affixed to an operating handle. A trip device, housed in a mid-cover of the molded case, separates the stationary and moveable contacts when a fault is sensed. The mid-cover comprises at least one auxiliary switch compartment, where a single auxiliary switch compartment is capable of housing multiple compatible auxiliary switches.

18 Claims, 13 Drawing Sheets

U.S. PATENT DOCUMENTS 4,479,143 10/1984 Watanabe et al. .
4,488,133 12/1984 McClellan et al. .
4,492,941 1/1985 Nagel .
4,541,032 9/1985 Schwab .
4,546,224 10/1985 Mostosi .
4,550,360 10/1985 Dougherty .
4,562,419 12/1985 Preuss et al. .
4,589,052 5/1986 Dougherty .
4,595,812 6/1986 Tamaru et al. .
4,611,187 9/1986 Banfi .
4,612,430 9/1986 Sloan et al. .
4,616,198 10/1986 Pardini .
4,622,444 * 11/1986 Kandatsu et al. ..... 200/303
4,631,625 12/1986 Alexander et al. .
4,642,431 2/1987 Tedesco et al. .
4,644,438 2/1987 Puccinelli et al. .
4,649,247 3/1987 Preuss et al. .
4,658,322 4/1987 Rivera .
4,672,501 6/1987 Bilac et al. .
4,675,481 6/1987 Markowski et al. .
4,682,264 7/1987 Demeyer .
4,689,712 8/1987 Demeyer .
4,694,373 9/1987 Demeyer .
4,710,845 12/1987 Demeyer .
4,717,985 1/1988 Demeyer .
4,733,211 3/1988 Castonguay et al. .
4,733,321 3/1988 Lindeperg .
4,764,650 8/1988 Bur et al. .
4,768,007 8/1988 Mertz et al. .
4,780,786 10/1988 Weynachter et al. .
4,831,221 5/1989 Yu et al. .
4,870,531 9/1989 Danek .
4,883,931 11/1989 Batteux et al. .
4,884,047 11/1989 Baginski et al. .
4,884,164 11/1989 Dziura et al. .
4,900,882 2/1990 Bernard et al. .
4,910,485 3/1990 Bolongeat-Mobleu et al. .
4,914,541 4/1990 Tripodi et al. .
4,916,420 4/1990 Bartolo et al. .
4,916,421 4/1990 Pardini et al. .
4,926,282 5/1990 McGhie .
4,935,590 6/1990 Malkin et al. .
4,937,706 6/1990 Schueller et al. .
4,939,492 7/1990 Raso et al. .
4,943,691 7/1990 Mertz et al. .
4,943,888 7/1990 Jacob et al. .
4,950,855 8/1990 Bolonegeat-Mobleu et al. .
4,951,019 8/1990 Gula .
4,952,897 8/1990 Barnel et al. .
4,958,135 9/1990 Baginski et al. .
4,965,543 10/1990 Batteux .
4,983,788 1/1991 Pardini .
5,001,313 3/1991 Leclerq et al. .
5,004,878 4/1991 Seymour et al. .
5,027,091 * 6/1991 Lesslie et al. ..... 335/132
5,029,301 7/1991 Nebon et al. .
5,030,804 7/1991 Abri .
5,057,655 10/1991 Kersusan et al. .
5,077,627 12/1991 Fraisse .
5,083,081 1/1992 Barrault et al. .
5,095,183 3/1992 Raphard et al. .
5,103,198 4/1992 Morel et al. .
5,115,371 5/1992 Tripodi .
5,120,921 6/1992 DiMarco et al. .
5,132,865 7/1992 Mertz et al. .
5,138,121 8/1992 Streich et al. .
5,140,115 8/1992 Morris .
5,153,802 10/1992 Mertz et al. .
5,155,315 10/1992 Malkin et al. .
5,166,483 11/1992 Kersusan et al. .
5,172,087 12/1992 Castonguay et al. .
5,178,504 1/1993 Falchi .
5,184,717 2/1993 Chou et al. .
5,187,339 2/1993 Lissandrin .
5,198,956 3/1993 Dvorak .
5,200,724 4/1993 Gula et al. .
5,210,385 5/1993 Morel et al. .
5,239,150 8/1993 Bolongeat-Mobleu et al. .
5,260,533 11/1993 Livesey et al. .
5,262,744 11/1993 Arnold et al. .
5,280,144 1/1994 Bolongeat-Mobleu et al. .
5,281,776 1/1994 Morel et al. .
5,296,660 3/1994 Morel et al. .
5,296,664 3/1994 Crookston et al. .
5,298,874 3/1994 Morel et al. .
5,300,907 4/1994 Nereau et al. .
5,310,971 5/1994 Vial et al. .
5,313,180 5/1994 Vial et al. .
5,317,471 5/1994 Izoard et al. .
5,331,500 7/1994 Corcoles et al. .
5,334,808 8/1994 Bur et al. .
5,341,191 8/1994 Crookston et al. .
5,347,096 9/1994 Bolongeat-Mobleu et al. .
5,347,097 9/1994 Bolongeat-Mobleu et al. .
5,350,892 9/1994 Rozier .
5,357,066 10/1994 Morel et al. .
5,357,068 10/1994 Rozier .
5,357,394 10/1994 Piney .
5,361,052 * 11/1994 Ferullo et al. ..... 335/172
5,373,130 12/1994 Barrault et al. .
5,379,013 1/1995 Coudert .
5,424,701 6/1995 Castonguary et al. .
5,438,176 8/1995 Bonnardel et al. .
5,440,088 8/1995 Coudert et al. .
5,446,386 * 8/1995 Pollman et al. ..... 335/132
5,449,871 9/1995 Batteux et al. .
5,450,048 9/1995 Leger et al. .
5,451,729 9/1995 Onderka et al. .
5,457,295 10/1995 Tanibe et al. .
5,467,069 11/1995 Payet-Burin et al. .
5,469,121 11/1995 Payet-Burin .
5,475,558 12/1995 Barjonnet et al. .
5,477,016 12/1995 Baginski et al. .
5,479,143 12/1995 Payet-Burin .
5,483,212 1/1996 Lankuttis et al. .
5,485,343 1/1996 Santos et al. .
5,493,083 2/1996 Olivier .
5,504,284 4/1996 Lazareth et al. .
5,504,290 4/1996 Baginski et al. .
5,510,761 4/1996 Boder et al. .
5,512,720 4/1996 Coudert et al. .
5,515,018 5/1996 DiMarco et al. .
5,519,561 5/1996 Mrenna et al. .
5,534,674 7/1996 Steffens .
5,534,832 7/1996 Duchemin et al. .
5,534,835 7/1996 McColloch et al. .
5,534,840 7/1996 Cuingnet .
5,539,168 * 7/1996 Linzenich ..... 200/303
5,543,595 8/1996 Mader et al. .
5,552,755 9/1996 Fello et al. .
5,581,219 * 12/1996 Nozawa et al. ..... 335/132
5,604,656 2/1997 Derrick et al. .
5,608,367 3/1997 Zoller et al. .
5,784,233 7/1998 Bastard et al. .

FOREIGN PATENT DOCUMENTS 38 02 184 8/1989 (DE) .
38 43 277 6/1990 (DE) .
44 19 240 1/1995 (DE) .
0 061 092 9/1982 (EP) .
0 064 906 11/1982 (EP) .

| | | |
|---|---|---|
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

AUXILIARY SWITCH MOUNTING CONFIGURATION FOR USE IN A MOLDED CASE CIRCUIT BREAKER

BACKGROUND OF THE INVENTION

The present invention relates to the mounting of auxiliary switches in a molded case circuit breaker and, more particularly, to customizing a molded case circuit breaker by providing a flexible packaging arrangement for mounting various types of auxiliary switches in a mid-cover of the molded case circuit breaker.

As electrical power distribution systems become more sophisticated, increasing demands are placed on circuit breakers to perform collateral functions in addition to their primary function of circuit protection. The circuit breaker can be customized for use in various applications. The customization is achieved by installing one or more auxiliary switches in the circuit breaker. Conventionally, the auxiliary switch is utilized for indicating the open or closed position of a pair of contacts, or for indicating tripping on a fault, or for any other control or indication function. The auxiliary switch cooperates electrically or mechanically with components of the circuit breaker.

Dependant on the individual demands of the circuit breaker, one or more auxiliary switches are used. When used in a molded case circuit breaker, the space available to accommodate these auxiliary switches is at a premium. Isolation of the auxiliary switches from live breaker parts in a circuit breaker case is essential for field installation of the auxiliary switch and also to maintain the integrity of the circuit breaker.

SUMMARY OF THE INVENTION

It is therefore desirable to provide a safe and flexible mounting method for installing auxiliary switches in the molded case circuit breaker. By installing the auxiliary switches in the circuit breaker one can customize the circuit breaker to meet individual applications.

The use of one compartment to house multiple auxiliary switches provides flexibility in the mounting of the auxiliary switches. To secure the auxiliary switch in its position within the compartment, a series of teeth are formed on both the auxiliary switch and on the auxiliary switch mating surface located on the mid-cover. The auxiliary switch is snapped into place, and the auxiliary unit teeth and the mid-cover teeth mesh, thereby preventing any rotational movement of the secured auxiliary switch.

BRIEF DESCRIPTION OF THE DRAWINGS

Referring now to the drawings wherein like elements are numbered alike in the several FIG. s.

DETAILED DESCRIPTION OF THE INVENTION

Figure 1:
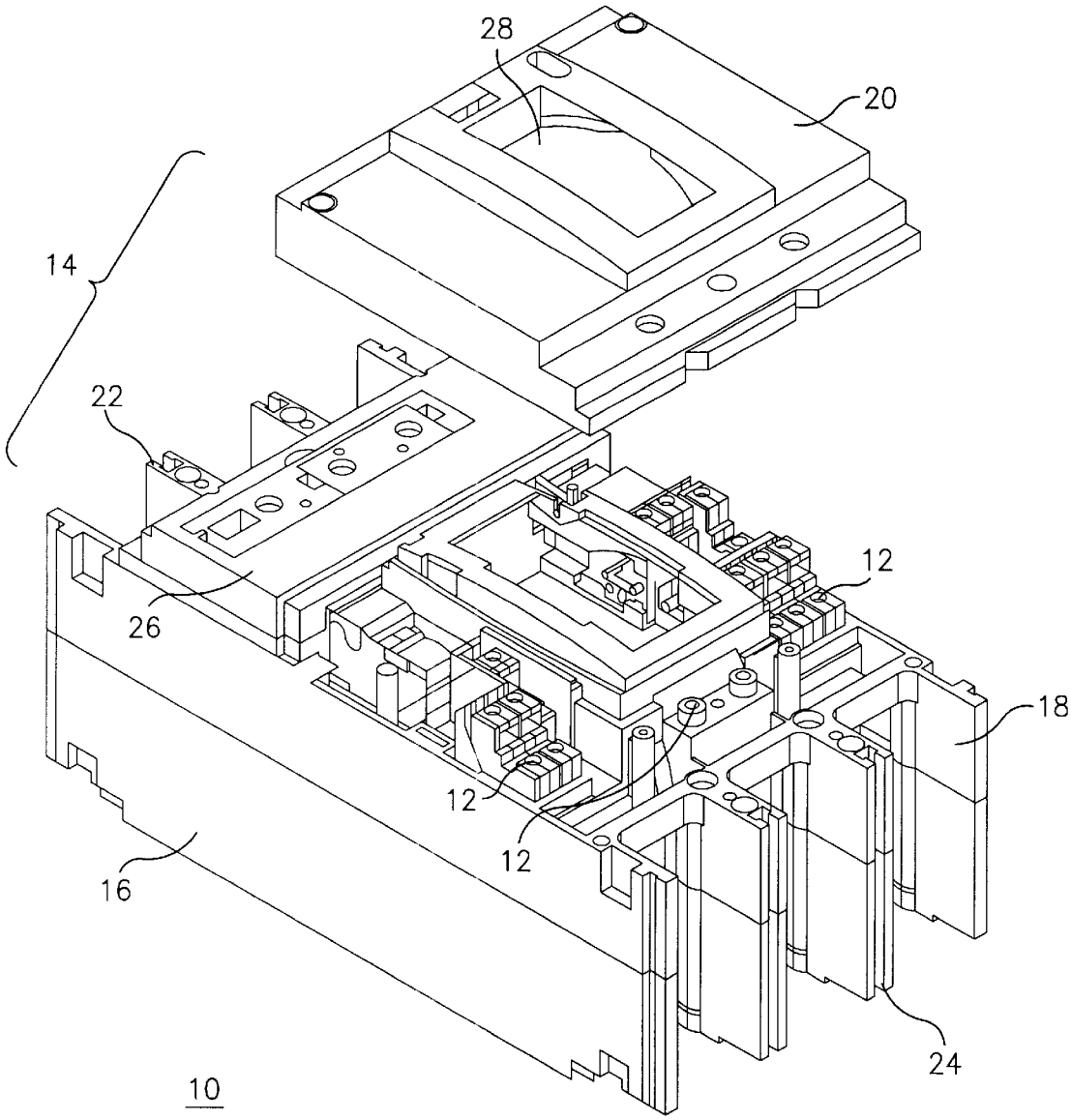
FIG. 1 is a left perspective view of a molded case circuit breaker comprising a base, a mid-cover and a top cover of the present invention.

FIG. 1 shows a molded case circuit breaker 10 of the present invention. The present invention as described, pertains to a three-pole circuit breaker, however, other circuit breaker assemblies can utilize the present invention. The illustrations are used to aid in describing the invention and are not meant to be limiting. The molded case circuit breaker 10 comprises a molded case 14 having a base 16, a mid-cover 18 and a top cover 20.

Figure 2:
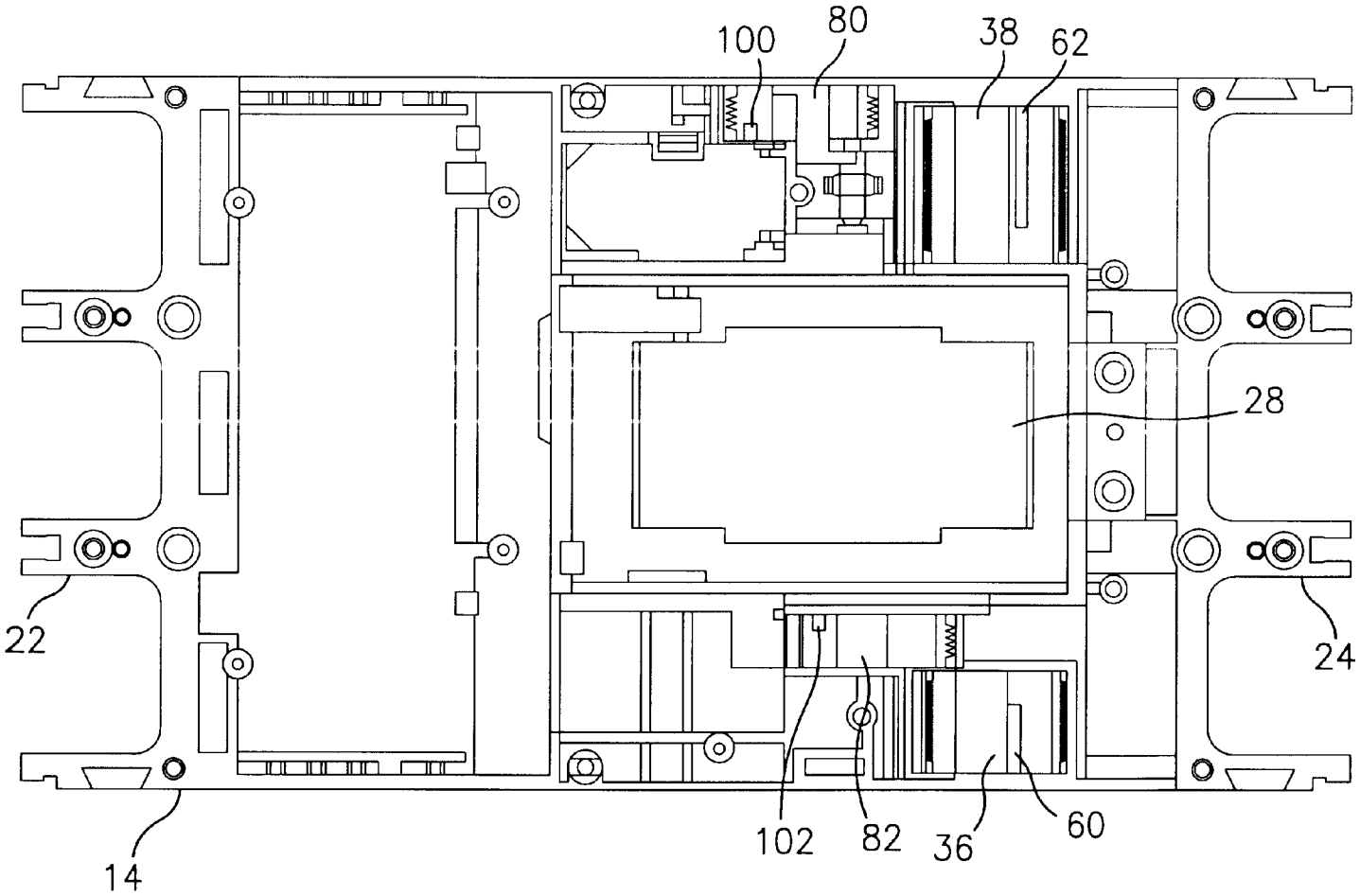
FIG. 2 is a top view of the circuit breaker mid-cover of FIG. 1.

Referring to FIG. 2, electrical connection with a plurality of current carrying components (not shown), which are located in the base 16, is made by a plurality of load terminal straps (not shown) and a plurality of line terminal straps (not shown), which extend from the load side 22 and the line side 24 of the circuit breaker. As is known in the art, each pole 12 of the circuit breaker 10 comprises a stationary contact and a movable contact, with the moveable contact being fastened to a moveable contact arm. The circuit breaker 10 also comprises a spring mechanism for actuating the moveable contact arm. As shown in FIG. 1, an electronic trip unit 26, contained in a recess of the mid-cover 18 controls the current carrying components of the circuit breaker 10. A circuit breaker operating handle (not shown) extends up from an access slot 28 formed in the top cover 20 and is connected to the spring mechanism.

Figure 3:
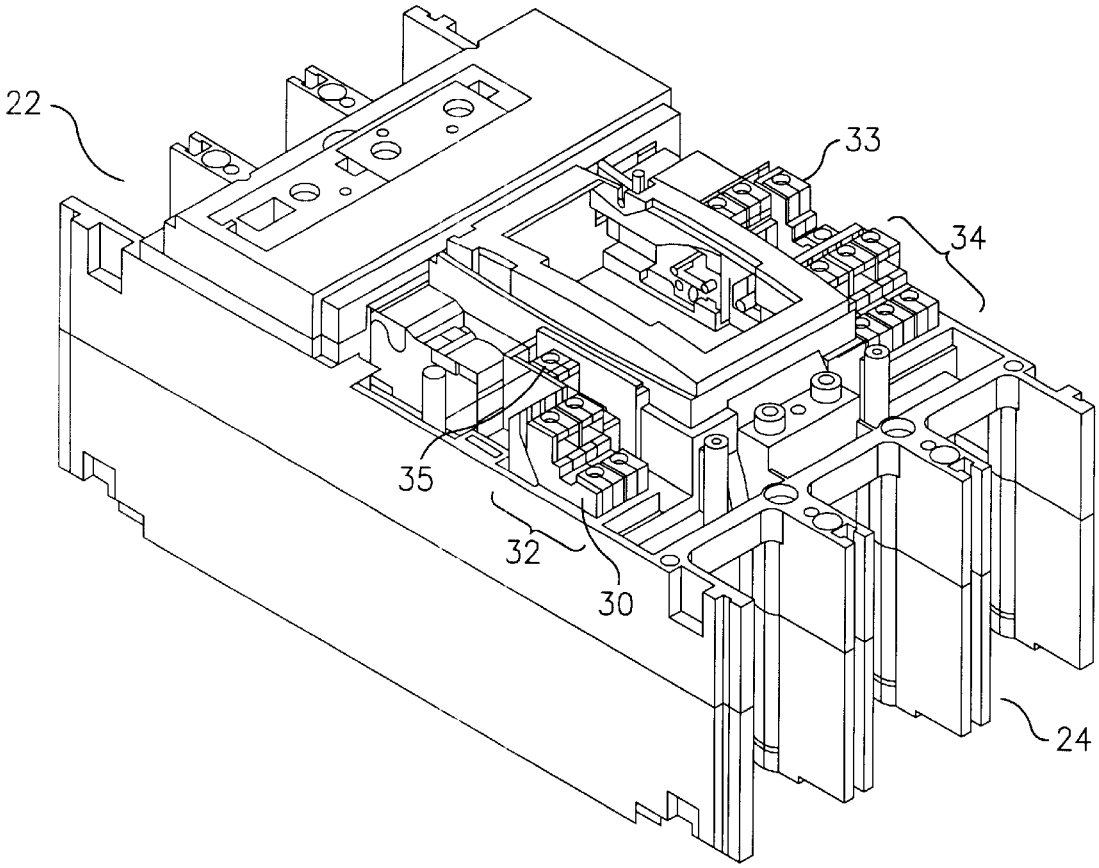
FIG. 3 is a left perspective view of the molded case circuit breaker of FIG. 1 with the top cover removed and a quantity of auxiliary switches installed.

Referring to FIG. 3, when the individual application of the circuit breaker 10 mandates customization, at least one auxiliary switch 30 is installed in the circuit breaker 10. Typically the auxiliary switch 30 is utilized for indicating the open or closed position of a pair of contacts, or for indicating tripping on a fault, or for any other control or indication function. The auxiliary switch 30 can be a unique right auxiliary switch 32 or a unique left auxiliary switch 34 configured to be a normally open or a normally closed switch. Other switches that can be installed in the circuit breaker 10, include but are not limited to, a unique bell alarm mechanism switch 33 and a unique bell alarm trip switch 35.

Figure 4:
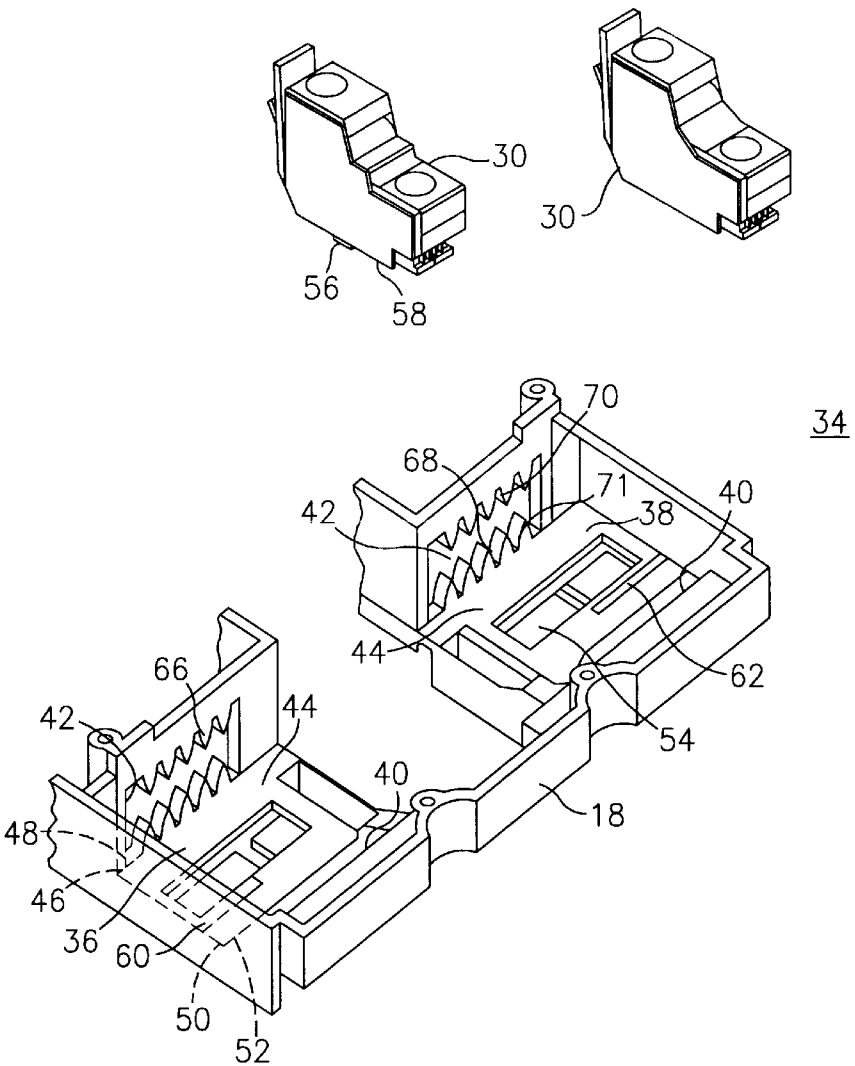
FIG. 4 is a left perspective view of a portion of the circuit breaker mid-cover of the preferred embodiment of the present invention.

Referring to FIG. 4, the mid-cover 18 comprises a right auxiliary switch compartment 36 and a left auxiliary switch compartment 38. The right and left auxiliary switch compartments 36, 38, are formed integral with the mid-cover 18. As best shown in FIG. 4, the right and left auxiliary compartments 36, 38, further comprise a front mounting surface 40, a rear mounting surface 42 and a bottom surface 44. The right and left auxiliary switch compartments 36, 38 generally exist as recesses in the mid-cover 18. The bottom surfaces 44 of the compartments 36, 38 are perpendicular to the front and rear mounting surfaces 40, 42. Where the bottom surface 44 is connected at a first end 46 to a first end 48 of the rear mounting surface 42 and the bottom surface 44 is connected at a second end 50 to a first end 52 of the front mounting surface 40.

The bottom surface 44 of the compartments comprises a generally rectangular opening 54, the opening 54 allows for the passage of a push button actuator 56 (shown in FIG. 6) which extends from a bottom surface 58 of the auxiliary switch 30. When the auxiliary switch 30 is installed in the circuit breaker 10, the push button actuator 56 extends into the molded case 14 base 16 and is actuated by circuit breaker components located in the base. Additionally, the bottom surface 44 of the right auxiliary switch compartment 36 further comprises a right rejection slot 60. The bottom surface 44 of the left auxiliary switch compartment 38 further comprises a left rejection slot 62. The role of the right and left rejection slots 60, 62 will be later described in greater detail.

Figure 7:
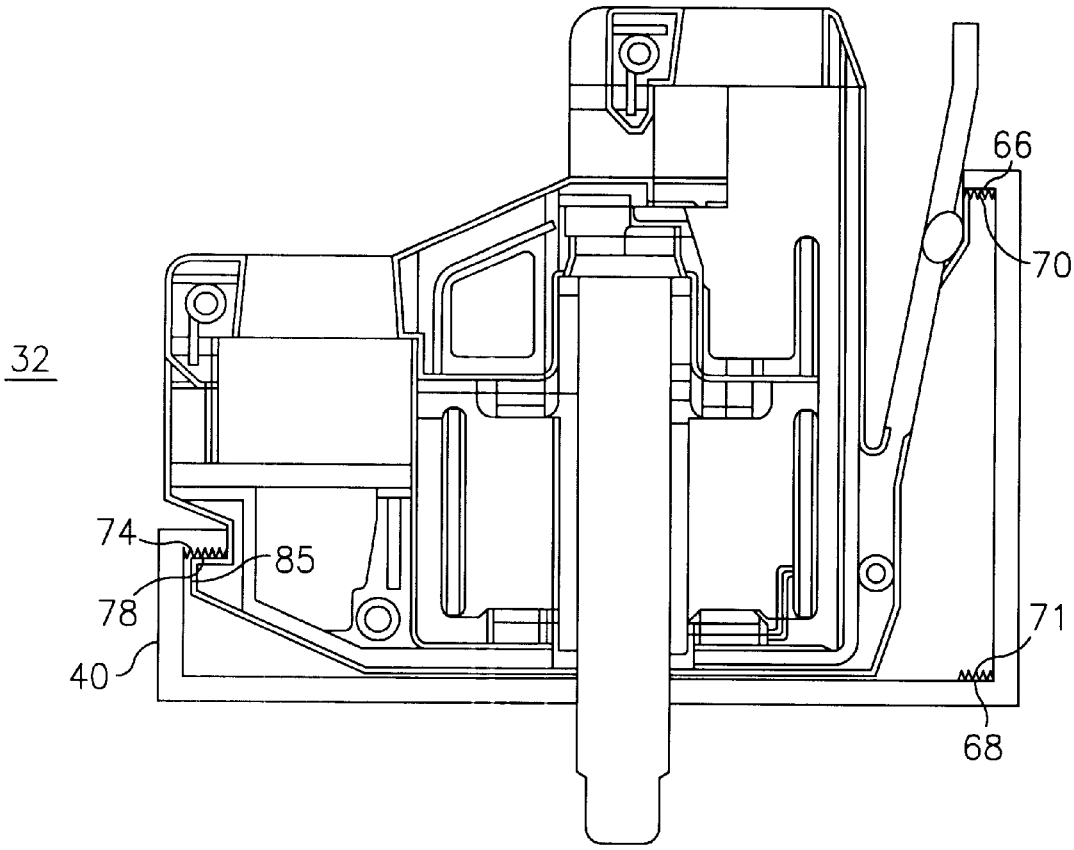
FIG. 7 is a side view of the auxiliary switch of FIG. 6 shown during installation into an auxiliary switch compartment.

The rear mounting surface 42 comprises a top horizontal edge 66 spaced a parallel distance from a bottom horizontal edge 68. Both the top and bottom horizontal edges 66, 68 comprise a series of shaped protrusions and indentations existing across the edges 66, 68. In the preferred embodiment the series of shaped protrusions and indentations formed on the top horizontal edge 66 is a series of top rear mounting teeth 70. A series of bottom rear mounting teeth 71 are formed on the bottom horizontal edge 68. The top rear mounting teeth 70 formed on the top horizontal edge 66 and the bottom rear mounting teeth 71 formed on the bottom horizontal edge 68 extend towards each other. The front mounting surface 40 comprises a top horizontal edge 74. As best shown in FIG. 7, the top horizontal edge 74 comprises a series of top front mounting teeth 78 that extend downward.

Among the possible switches 30 that can be installed in the right and left auxiliary switch compartments 36, 38, are the unique right auxiliary switch 32 and the unique left auxiliary switch 34, the switches being a normally open or a normally closed switch. For example, a plurality of unique right auxiliary switches 32 can be installed in the right auxiliary switch compartment 36, with some of the switches 32 being normally open, normally closed, or any combination of the two. These different types of unique right auxiliary switches 32 can be placed anywhere in the right auxiliary switch compartment 36.

Figure 6:
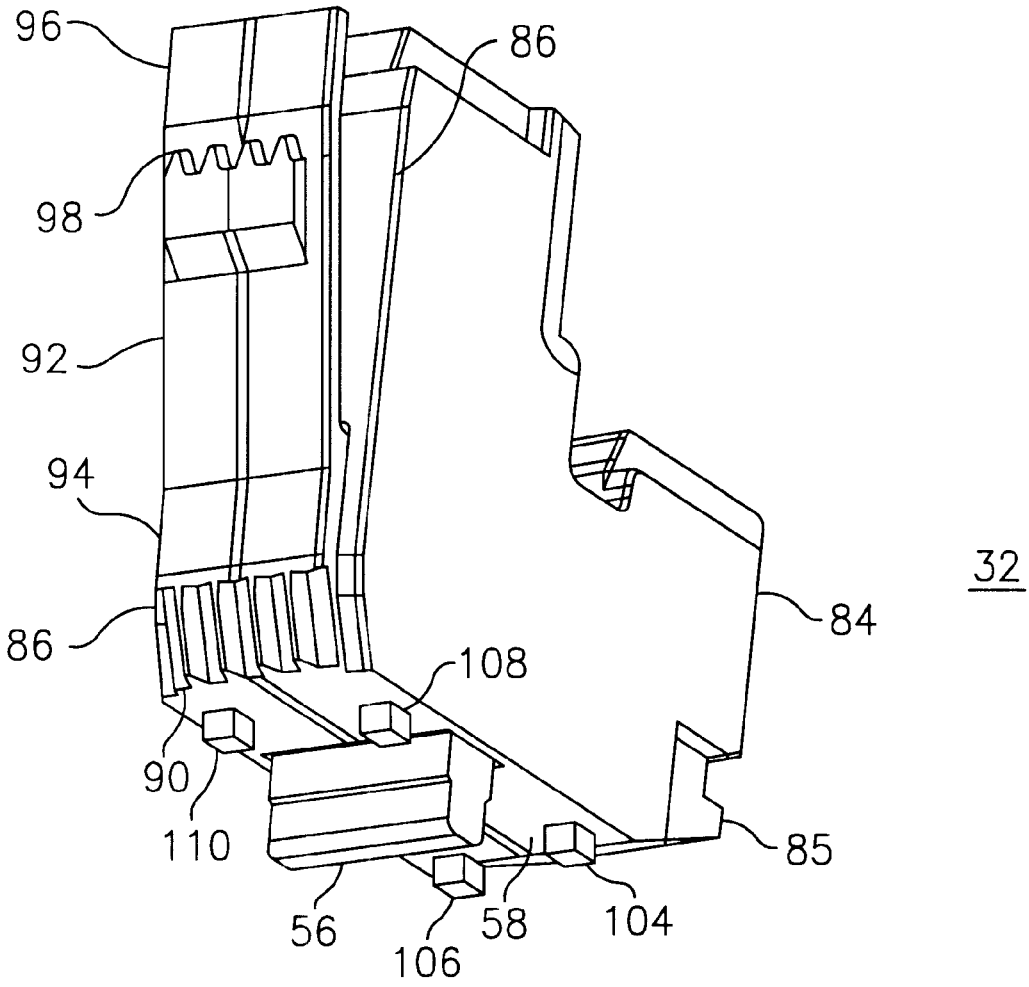
FIG. 6 is a rear perspective view of an auxiliary switch of FIG. 4.
Figure 9:
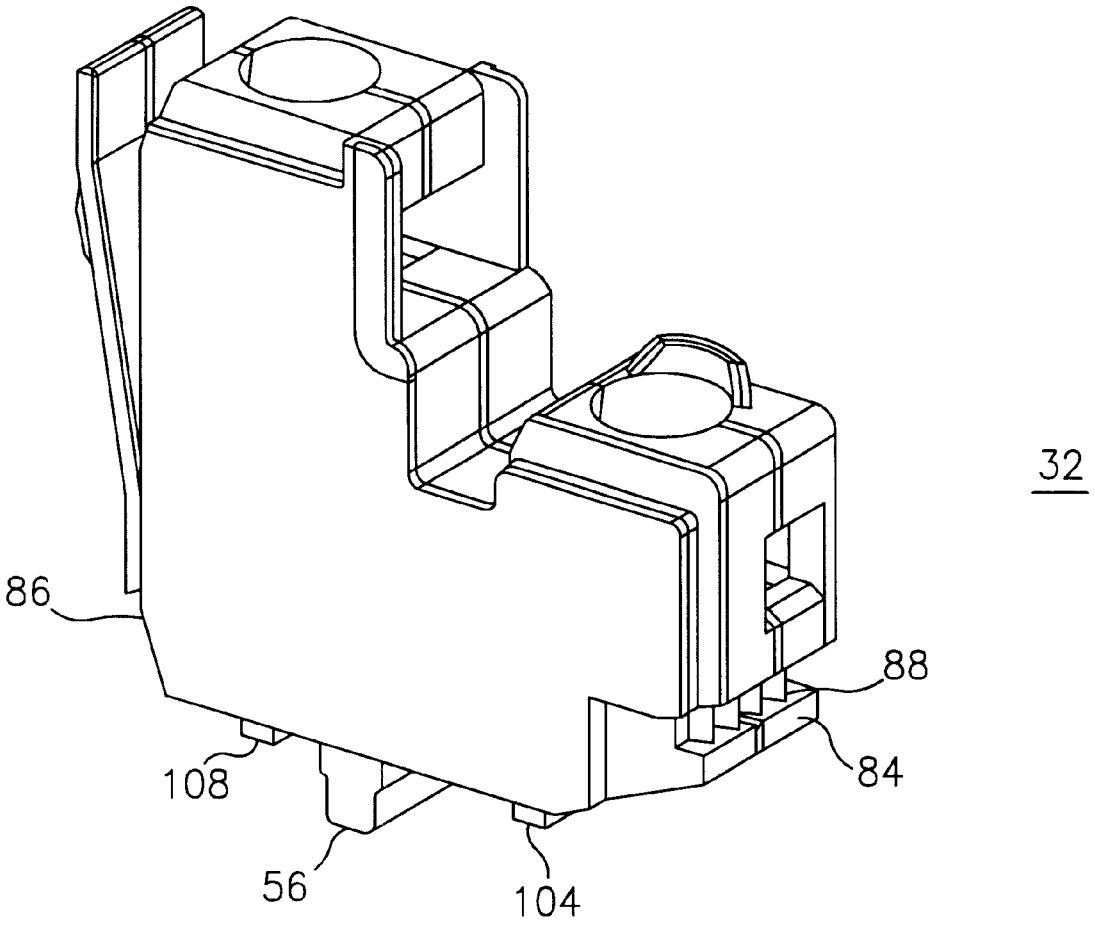
FIG. 9 is a left perspective view of the auxiliary switch of FIG. 6.
Figure 10:
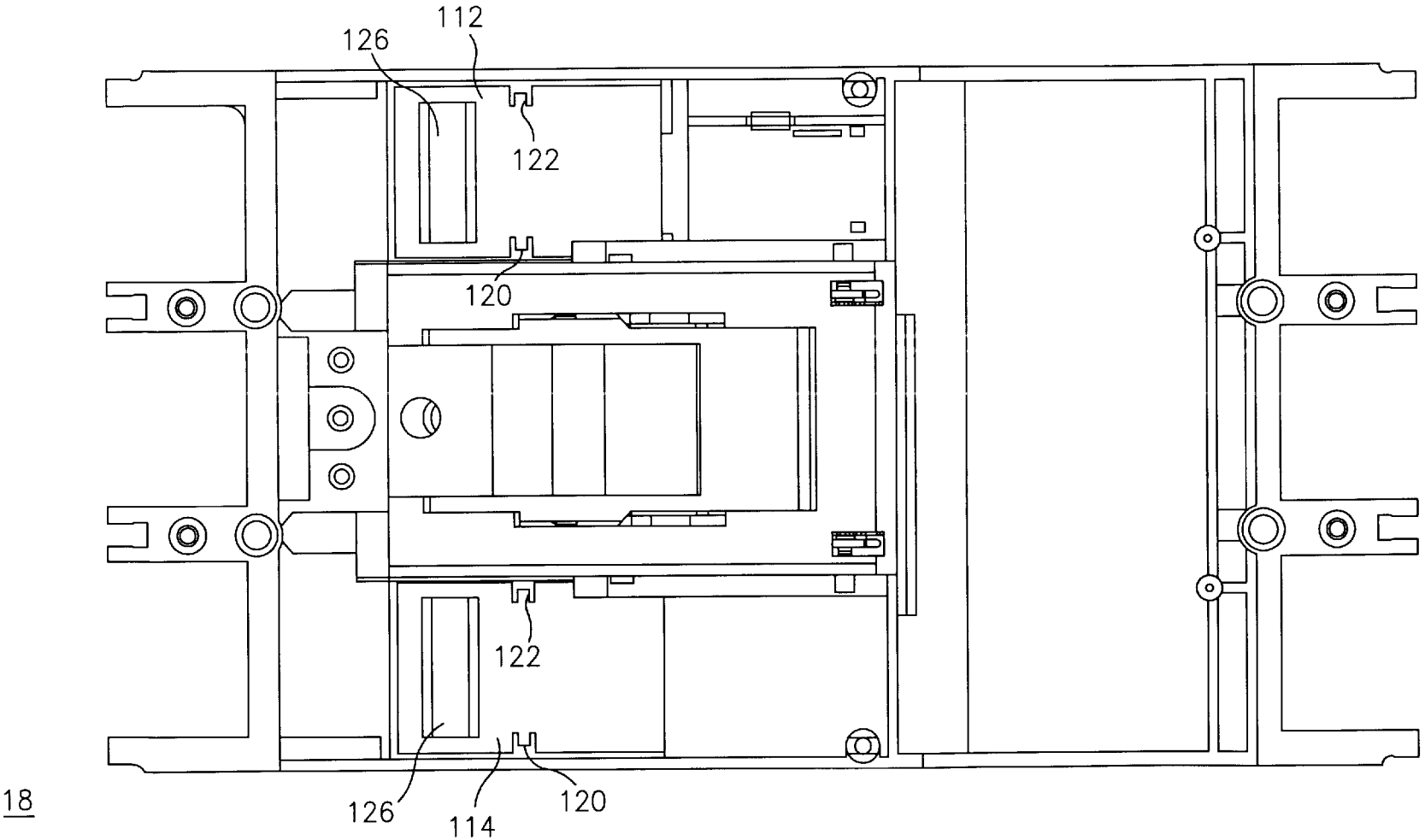
FIG. 10 is a top view of the circuit breaker mid-cover of a second embodiment of the present invention.

The auxiliary switches 30 are uniformly packaged, referring to FIGS. 6, 7 and 9 a unique right auxiliary switch is shown, the only distinction between the outward appearance of the various auxiliary switches 30 is the addition of a rejection pin 83 formed on the bottom surface 58 of the auxiliary switch 30. The rejection pin 83 is oriented differently for each of the unique switches. For simplicity, when describing the auxiliary switches 30, emphasis is on the unique right auxiliary switch 32. It being understood that any of the auxiliary switches, including a unique left auxiliary switch 34, would be packaged in a similar manner, the only external difference being the location of the rejection pin 83.

The right auxiliary switch 32 further comprises a front surface 84 and a rear surface 86. The front surface 84 having a tab 85 disposed thereon, the tab 85 having a series of top front auxiliary teeth 88 extending upward from the tab. Teeth 88 are arranged to mesh with the top front mounting teeth 78 when installed. The rear surface 86 of the auxiliary switch 32 comprises a series of bottom rear auxiliary teeth 90 that mesh with the bottom rear mounting teeth 71 when installed. Extending upward from the rear surface 86 above a bottom rear auxiliary teeth 90 is a mounting prong 92. A first end 94 of the mounting prong 92 is attached to the right auxiliary switch 32 at a point just above the bottom rear auxiliary teeth 90. The mounting prong 92 is thin and flexible in comparison with the auxiliary switch 32. The mounting prong 92 extends upward from the first end 94, it angles slightly away from the rear surface 86 of the auxiliary switch 32. A second end 96 of the mounting prong 92 is separated a distance from the rear surface 86 of the auxiliary switch 32. A series of top rear auxiliary teeth 98 which are pointed upward are positioned near the second end 96 of the mounting prong 92.

When installing the auxiliary switch 32 into the right auxiliary switch compartment 36, the top front auxiliary teeth 88 are installed first so that they mesh with the top front mounting teeth 78 and tab 85 extends beneath the top horizontal edge 74. Once the front teeth 88, 78 mesh, the auxiliary switch is retracted backwards so that the bottom rear auxiliary teeth 90 mesh with the bottom rear mounting teeth 71. Finally the mounting prong 92 is flexed so that the top rear auxiliary teeth 98 can snap into place and mesh with the top rear mounting teeth 70. Flexibility in mounting is enhanced because, the teeth 70, 71, 78 extend along the length of the right auxiliary switch compartment 36 and the rectangular opening 54 extends for a considerable length through the bottom surface. Therefore, a single right auxiliary switch 32 can be positioned anywhere in the compartment.

Figure 5:
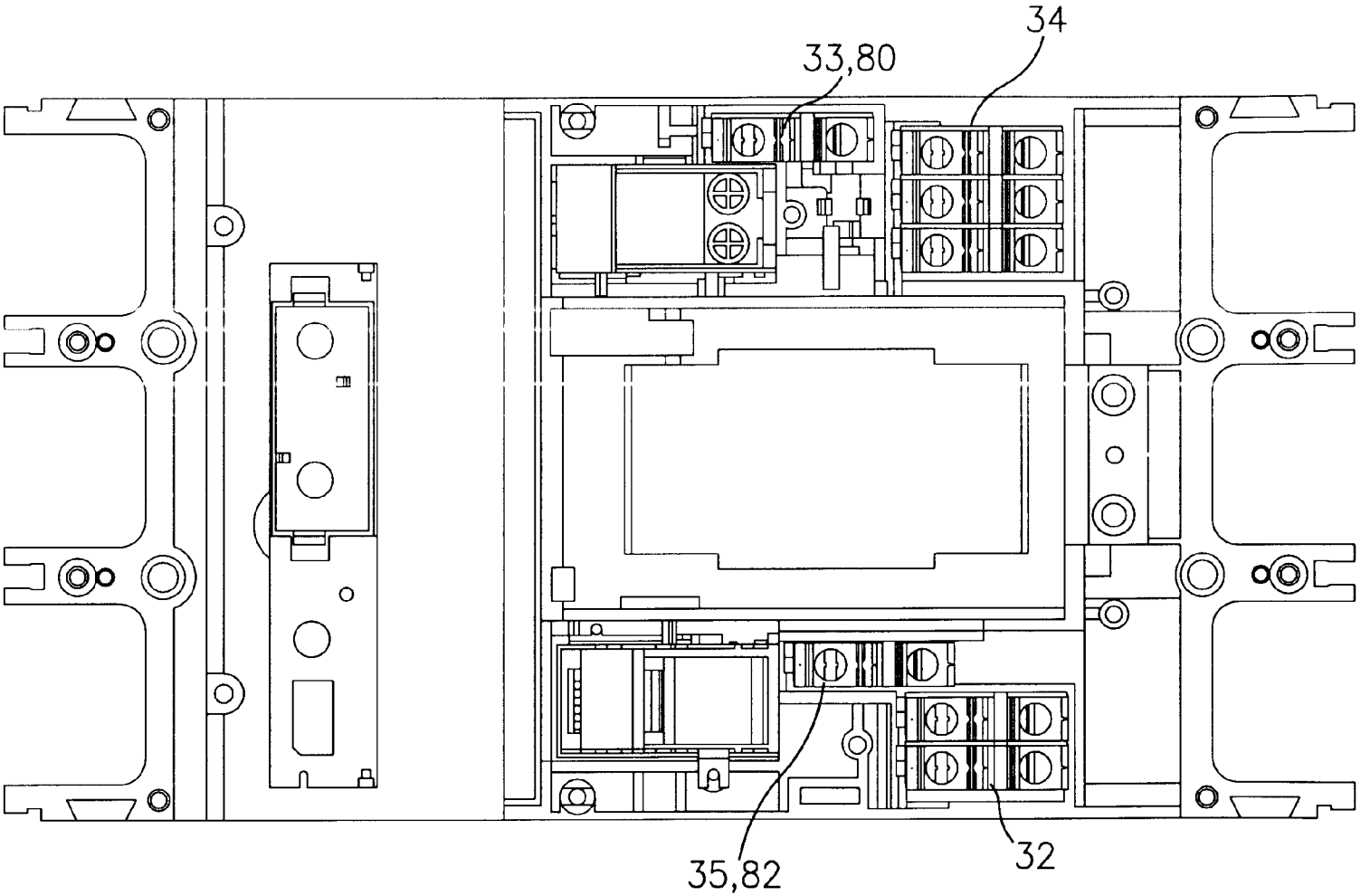
FIG. 5 is a top view of the circuit breaker mid-cover of FIG. 4 with a quantity of auxiliary switches installed.

Referring to FIGS. 2 and 5, the mid-cover 18 can further comprise a bell alarm mechanism switch compartment 80 for housing the unique bell alarm mechanism switch 33 and a bell alarm trip switch compartment 82 for housing the unique bell alarm trip switch 35. The bell alarm mechanism switch compartment 80 comprises a bell alarm mechanism rejection slot 100 and the bell alarm trip switch compartment 82 comprises a bell alarm trip rejection slot 102. The bell alarm compartments 80, 82 could be located in the mid-cover 18 as shown in FIG. 2. The unique designation indicates the lack of interchangeability. To ensure that the unique left auxiliary switch 34, the unique right auxiliary switch 32, the unique bell alarm mechanism switch 33 and the unique bell alarm trip switch 35 are not accidentally installed in the wrong compartment, the rejection slots prevent the installation of an auxiliary switch in an incompatible compartment.

Figure 8:
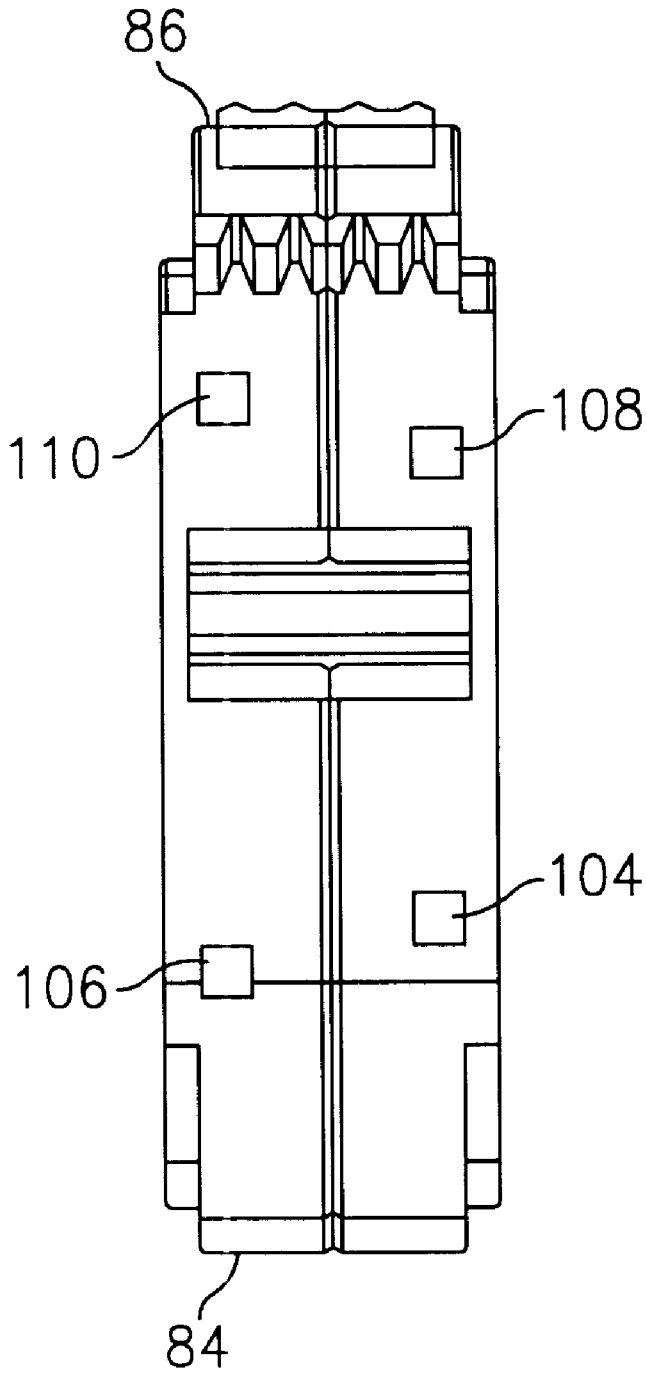
FIG. 8 is a bottom view of the auxiliary switch of FIG. 6.

As shown in FIG. 2, each of the compartments 36, 38, 80, 82 comprises a uniquely positioned rejection slot 60, 62, 100, 102. Likewise, as shown in FIG. 6, each of the unique auxiliary switches 32, 34, 33, 35 comprises a uniquely positioned rejection pin 104, 106, 108, 110. Referring to FIG. 8, an auxiliary switch 30 is shown comprising a right auxiliary switch rejection pin 104, a left auxiliary switch rejection pin 106, a bell alarm mechanism switch rejection pin 108 and a bell alarm trip switch rejection pin 110. In a preferred embodiment, each of the unique switches 32, 34, 33, 35 would comprise only their accompanying rejection pin 104, 106, 108 or 110. An alternative embodiment could comprise each unique switch comprising all four rejection pins 104, 106, 108, 110 wherein the installer would discard the three unrelated pins leaving the compatible rejection pin for the individual switch.

Each of the unique switches 32, 34, 33, 35 comprises an accompanying rejection pin 104, 106, 108, 110 and each of the compartments 36, 38, 80, 82 comprises a rejection slot 60, 62, 100, 102 positioned to accept only the auxiliary switch designed to work in the particular compartment. Therefore, the possibility of improper installation is eliminated.

Referring to FIGS. 10–15, according to a further embodiment, the mid-cover 18 of the molded case 14 comprises a right auxiliary compartment 112 and a left auxiliary compartment 114. The right auxiliary compartment 112 is used to house at least one unique right auxiliary switch 116 and the left auxiliary compartment 114 is used to house at least one unique left auxiliary switch 118. The auxiliary compartments 112, 114 are formed generally as a recess in the mid-cover 18 of a molded case 14 used in a molded case circuit breaker 10 (FIG. 1).

The compartments 112, 114 each comprise a first rear mounting channel 120, a second rear mounting channel 122, a base 124 and a front mounting surface 128. The channels 120, 122, base 124 and front mounting surface 128 are ideally formed as an integral part of the mid-cover 18. The base further comprises an actuator access opening 126 used to allow passage of a push bottom actuator 130 extending from a bottom surface 132 of the right and left auxiliary switch 116, 118.

Figure 11:
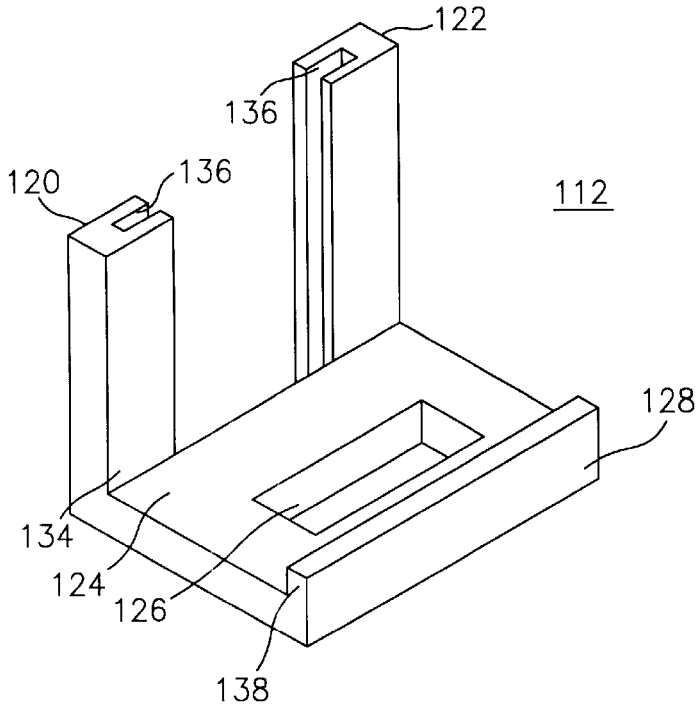
FIG. 11 is a left perspective view of an auxiliary switch compartment of the circuit breaker mid-cover of FIG. 10.

The right auxiliary compartment 112 is shown in FIG. 11. Although not shown in FIG. 11, the left auxiliary compartment 114 is identical. For ease of illustration, the right auxiliary compartment 112 will be described and unless otherwise noted, the right and left auxiliary compartment 112, 114 will use substantially similar elements.

Referring to FIG. 11, the right auxiliary compartment 112 comprises the first rear mounting channel 120 and the second rear mounting channel 122. The channels 120, 122 are perpendicular to the base 124 and are located at a first end 134 of the base. The channels extend upward from the base 124. Each channel 120, 122 has a U-shaped opening 136 extending through the length of the channel 120, 122. The U-shaped openings 136 on the first channel 120 and the second channel 122 point towards one another as shown in FIG. 11.

The front mounting surface 128 further comprises a top horizontal edge 138, the edge 138 being similar to the top horizontal edge 74 used in the preferred embodiment, the only difference being the edge 138 does not comprise the teeth 78.

Figure 14:
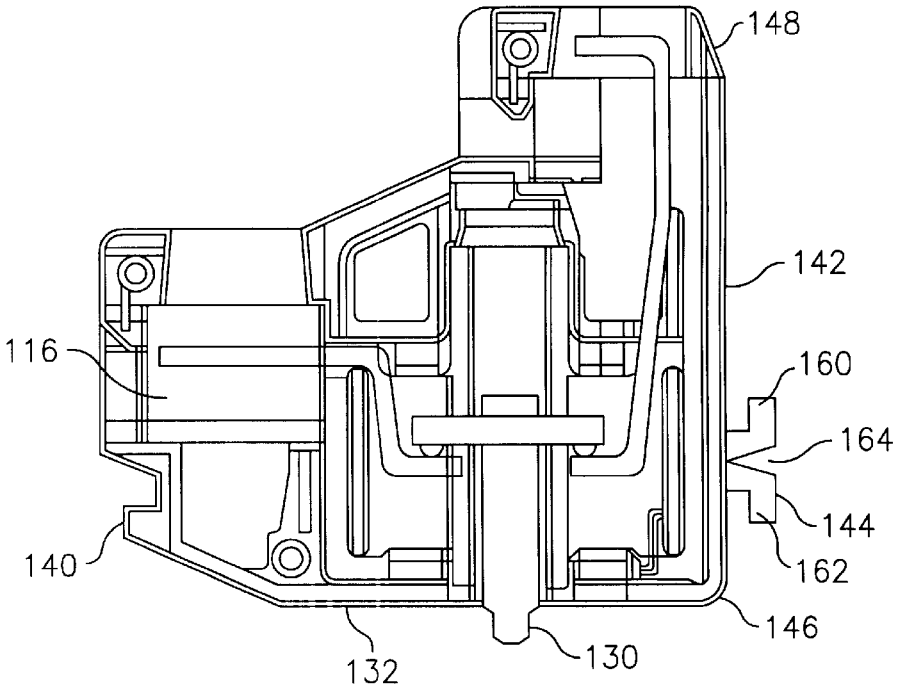
FIG. 14 is a side view of an auxiliary switch for use with the circuit breaker mid-cover of FIG. 10.
Figure 15:
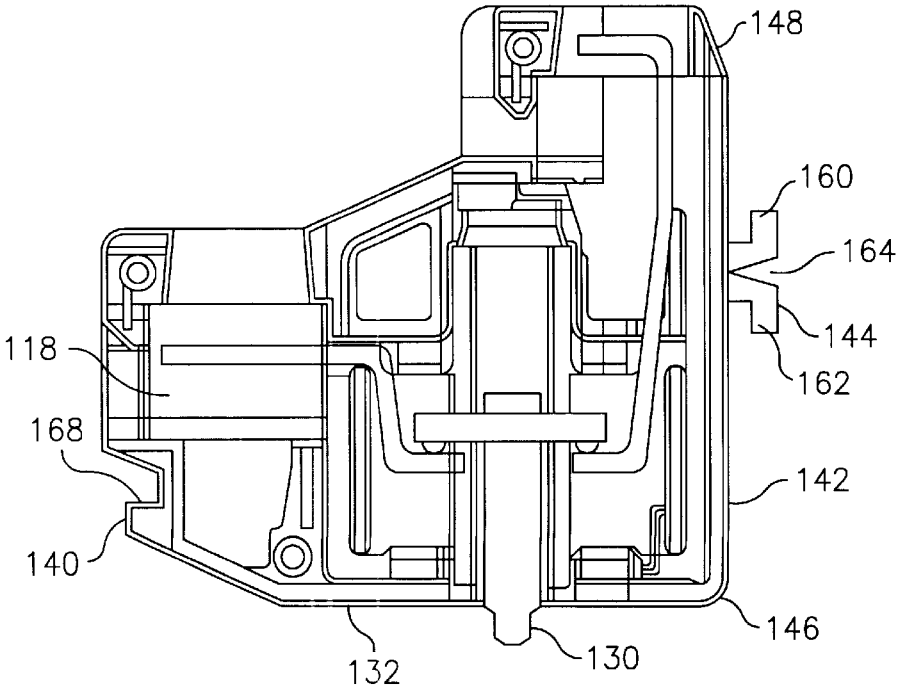
FIG. 15 is a side view of the auxiliary switch of FIG. 14.

Referring to FIGS. 14 and 15, the unique right auxiliary switch 116 and the unique left auxiliary switch 118 further comprise a front surface 140, a rear surface 142 and the bottom surface 132. The rear surface 142 of the switches 116, 118 further comprises a projection 144 that extends away from the switch 116, 118. The projection 144 can be oriented near a bottom end 146 of the rear surface 142 or near a top end 148 of the rear surface 142. It is the orientation of the projection 144 that prevents erroneous installation of the unique auxiliary switches 116, 118 into the wrong auxiliary compartment 112 or 114.

It will be seen that all of the right auxiliary switches 116 preferably have the projections 144 located in the same position. Likewise, the unique left auxiliary switch 118 preferably have the projections 144 located in the same position, with the position of the projection 144 on the left auxiliary switch 118 different from the position of the right auxiliary switch 116. For ease of illustration the right auxiliary switch 116 will have the projection 144 located near the bottom end 146 of the rear surface 142 and the left auxiliary switch 118 will have the projection 144 located near the top end 148 of the rear surface 142.

Figure 12:
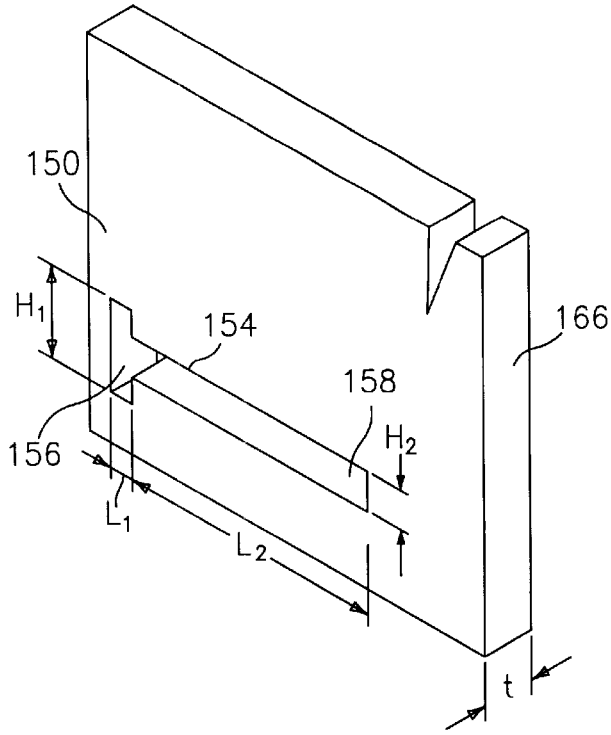
FIG. 12 is a left perspective view of a bottom mounting rail for use with the auxiliary switch compartment of FIG. 10.
Figure 13:
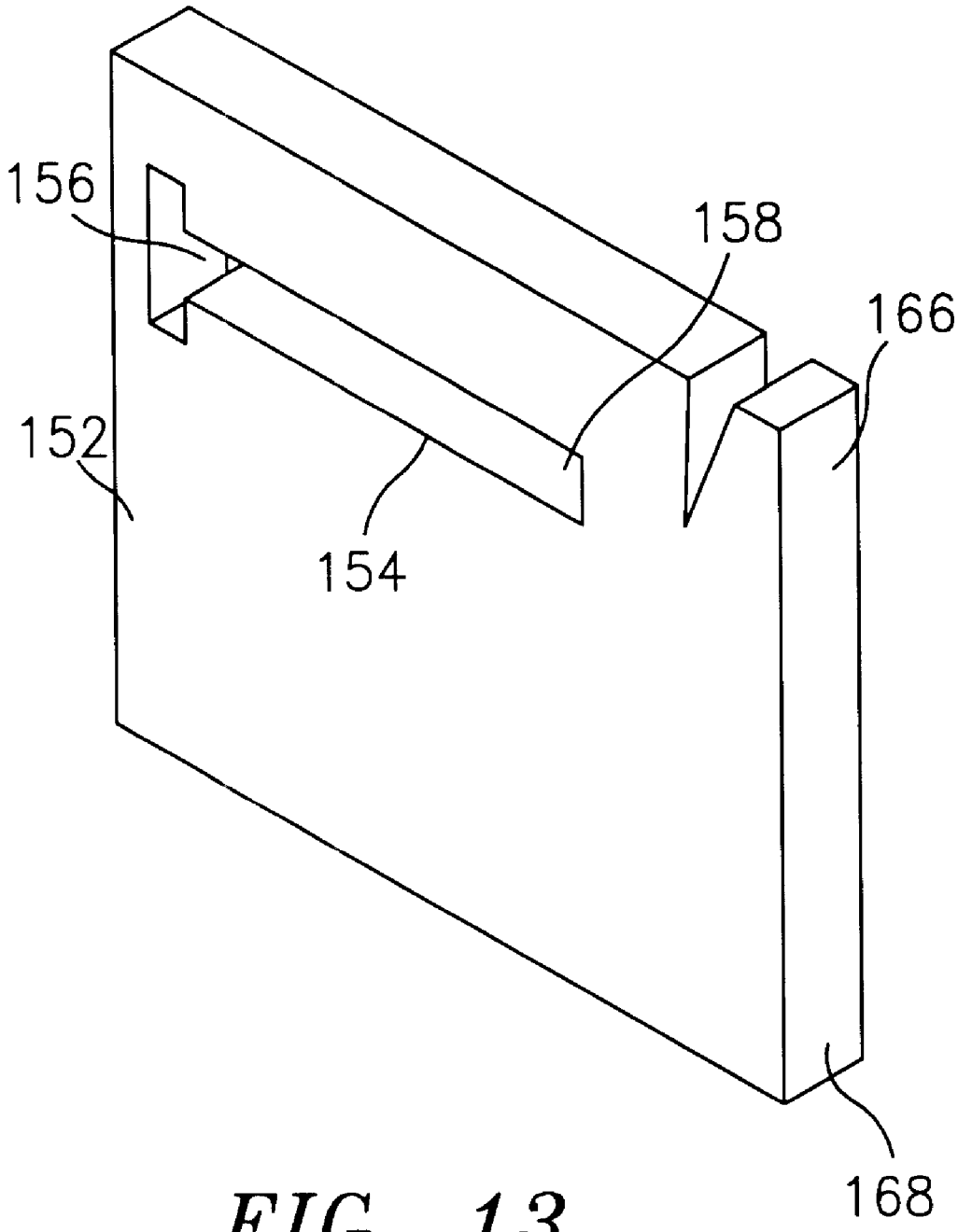
FIG. 13 is a left perspective view of a top mounting rail for use with the auxiliary switch compartment of FIG. 10.

Referring to FIGS. 12–15, the projection 144 is designed to slidingly engage a bottom mounting rail 150 or a top mounting rail 152. The right auxiliary switch 116 comprising projections 144 oriented near the bottom end 146 will engage the bottom mounting rail 150 (FIG. 12). The left auxiliary switch 118 comprising projections 144 oriented near the top end 148 will engage the top mounting rail 152 (FIG. 13). Both the bottom and top mounting rails 150, 152 comprise a T-shaped opening 154 extending through the thickness "t" of the rails 150, 152. The T-shaped opening 154 comprises a first opening 156 having a height of H1 and a length of L1. The T-shaped opening 154 further comprises a second opening 158 having a height of H2 and a length of L2. Where H1 is greater than H2 and L2 is considerably greater than L1. The first opening 156 being contiguous with the second opening 158.

The projection 144 further comprises a top lip 160 and a bottom lip 162 separated by a notch 164. The notch 164 enables compression of the top lip 160 and the bottom lip 162 towards one another. The engagement of the auxiliary switch 116, 118 on its accompanying mounting rail 150, 152, is facilitated by, squeezing the top lip 160 and the bottom lip 162 together so that the top and bottom lip 160, 162 can pass through the first opening 156 on the mounting rail 150, 152. Once the top and bottom lip 160, 162 pass through the first opening 156, the auxiliary switch 116, 118 is secured to the mounting rail 150, 152. To position the auxiliary switch 116, 118, the top and bottom lip 160, 162 are squeezed towards one another and slid along the mounting rail 150, 152. The long second opening 158 enables one to mount multiple compatible auxiliary switches 116, 118 on a single rail 150, 152.

Referring to FIGS. 11, 12 and 14, once the required auxiliary switches 116, 118 are mounted on the compatible rail 150, 152, the rail can slide into the compartment 112, 114. The bottom mounting rail 150 slides into the U-shaped openings 136 on the first and second rear mounting channels 120, 122. A top edge 168 on the front surface 140 of the right auxiliary switch 116 is engaged under the edge 138 of the front surface 128 as the bottom mounting rail 150, assembled with at least one right auxiliary switch 116, is slid into place. To ensure that the mounting rail 150 is snuggly fit into the first and second mounting channels 120, 122, a flexible extension 166 is included on a first end of the mounting rail 150. As the mounting rail 150 slides in the channels 120, 122 the flexible extension 166 is compressed to snugly hold the mounting rail 150 in place.

The auxiliary switch mounting configuration described herein allows customization of a molded case circuit breaker by installing auxiliary switches. By utilizing one left side compartment and one right side compartment an installer can effortlessly install various combinations of auxiliary switches into each compartment. There is a unique left side auxiliary switch which is intended for installation only in the left side compartment and a unique right side auxiliary switch which is intended for installation only in the right side compartment. The unique left side auxiliary switch and the unique right side auxiliary switch are designed to prevent against erroneous installation.

It will be understood that a person skilled in the art may make modifications to the embodiments shown herein within the scope and intent of the claims. While the present invention has been described as carried out in specific embodiments thereof, it is not intended to be limited thereby but is intended to cover the invention broadly within the scope and spirit of the claims.

What is claimed is:

1. A circuit breaker assembly comprising:

a case having a base and a cover, the cover including a first auxiliary switch compartment recessed into the cover and having a substantially U-shaped cross-section defined by a rear surface, a bottom surface and a front surface, the bottom surface having a first slot, the cover further including a second auxiliary switch compartment recessed into the cover and having a substantially U-shaped cross-section defined by a rear surface, a bottom surface and a front surface, the bottom surface of the second auxiliary switch compartment having a second slot, the first auxiliary switch compartment having a first length from the front surface of the first auxiliary switch compartment to the rear surface of the first auxiliary switch compartment which is substantially equal to a second length measured from the front surface of the second auxiliary switch compartment to the rear surface of the second auxiliary switch compartment, a distance from the second slot to the front surface of the second auxiliary switch compartment being less than a distance from the first slot to the front surface of the first auxiliary switch compartment;

a first auxiliary switch sized for receipt in the first auxiliary switch compartment, the first auxiliary switch having a bottom surface with a first pin protruding from the bottom surface of the first auxiliary switch, wherein the first pin aligns with the first slot when the first auxiliary switch is placed within the first auxiliary switch compartment and wherein the first pin abuts with the bottom surface of the second auxiliary switch compartment when the first auxiliary switch is placed within the second auxiliary switch compartment;

a second auxiliary switch sized for receipt in the second auxiliary compartment, the second auxiliary switch having a bottom surface with a second pin protruding from the bottom surface of the second auxiliary switch, wherein the second pin aligns with the second slot when the second auxiliary switch is placed within the second auxiliary switch compartment and wherein the second pin abuts with the bottom surface of the first auxiliary switch compartment when the second auxiliary switch is placed within the first auxiliary switch compartment.

2. The circuit breaker assembly of claim 1 wherein the first auxiliary switch compartment is sized to receive a plurality of auxiliary switches, and wherein the rear surface of the first auxiliary switch compartment comprises a top row of continuous teeth and a bottom row of continuous teeth.

3. The circuit breaker assembly of claim 2 wherein the first auxiliary switch comprises a rear surface, a prong attached at a first end to the rear surface of the first auxiliary switch adjacent the bottom surface of the first auxiliary switch, a second end of the prong spaced from the rear surface of the first auxiliary switch and compressible towards the rear surface of the first auxiliary switch.

4. The circuit breaker assembly of claim 3 wherein the prong comprises a bottom set of teeth adjacent the first end of the prong and a top set of teeth adjacent the second end of the prong, wherein the bottom set of teeth of the prong is meshable with teeth from the bottom row of continuous teeth of the rear surface of the first auxiliary switch anywhere along the bottom row of continuous teeth and the top set of teeth of the prong is meshable with teeth from the top row of continuous teeth of the rear surface of the first auxiliary switch anywhere along the top row of continuous teeth upon compression of the second end of the prong towards the rear surface of the first auxiliary switch.

5. The circuit breaker assembly of claim 1 wherein the first auxiliary switch compartment is sized to receive a plurality of auxiliary switches, and wherein the front surface of the first auxiliary switch compartment comprises a top row of continuous teeth.

6. The circuit breaker assembly of claim 5 wherein the first auxiliary switch comprises a front surface having a set of teeth meshable with the top row of continuous teeth on the front surface of the first auxiliary switch compartment anywhere along the top row of continuous teeth on the front surface of the first auxiliary switch compartment.

7. The circuit breaker assembly of claim 1 wherein the bottom surface of the first auxiliary switch comprises a plurality of pins, including the first pin and the second pin, protruding from the bottom surface of the first auxiliary switch, wherein all pins except the first pin must be removed prior to placing the first auxiliary switch within the first auxiliary switch compartment.

8. The circuit breaker assembly of claim 1 wherein the bottom surface of the second auxiliary switch comprises a plurality of pins, including the first pin and the second pin, protruding from the bottom surface of the second auxiliary switch, wherein all pins except the second pin must be removed prior to placing the second auxiliary switch within the second auxiliary switch compartment.

9. The circuit breaker assembly of claim 1 wherein the cover includes an access slot for a circuit breaker handle, the first auxiliary switch compartment positioned adjacent a first side of the access slot and the second auxiliary switch compartment positioned adjacent a second side of the access slot, the second side of the access slot opposite the first side of the access slot.

10. A circuit breaker assembly comprising:

a case having a cover;

a first auxiliary switch compartment recessed in the cover, the first auxiliary switch compartment having a base, a first mounting channel and a second mounting channel mounted substantially perpendicularly to a first end of the base, the first mounting channel having a U-shaped opening facing a U-shaped opening in the second mounting channel, a second end of the base abutting a front surface of the first auxiliary switch compartment;

a first wall-like mounting rail slidable within the U-shaped opening of the first mounting channel and the U-shaped opening of the second mounting channel, the first mounting rail including a first rail opening;

a first auxiliary switch having a bottom surface, a front surface, and a rear surface, the rear surface of the first auxiliary switch having a projection passable through the first rail opening and slidable anywhere along the first rail opening;

wherein, upon inserting the projection through the first rail opening of the first wall-like mounting rail and sliding the first wall-like mounting rail into the first and second mounting channels, the front surface of the first auxiliary switch abuts the front surface of the first auxiliary switch compartment.

11. The circuit breaker assembly of claim 10 wherein the first rail opening is a T-shaped opening having a first short opening perpendicular to a second long opening.

12. The circuit breaker assembly of claim 11 wherein the projection includes a top lip and a bottom lip separated by a notch, the top lip and bottom lip being squeezable towards each other, wherein the top lip and the bottom lip prevent the projection from being removed from the first wall-like mounting rail through the second long opening of the first rail opening.

13. The circuit breaker assembly of claim 10 wherein the first wall-like mounting rail includes a top end and a bottom end, the top end of the first wall-like mounting rail including a flexible extension extending outwardly from the first wall-like mounting rail, wherein the flexible extension is compressed upon insertion of the first-wall-like mounting rail into the first and second mounting channels.

14. The circuit breaker assembly of claim 11 wherein a length of the first short opening is less than a length of the second long opening and a height of the first short opening is greater than a height of the second long opening.

15. The circuit breaker assembly of claim 10 wherein the first auxiliary switch compartment and the first wall-like mounting rail are sized to hold a plurality of first auxiliary switches.

16. The circuit breaker assembly of claim 10 wherein the rear surface of the first auxiliary switch includes a top end and a bottom end, and wherein the projection is closer to the bottom end than the top end.

17. The circuit breaker assembly of claim 16 further comprising a second auxiliary switch compartment recessed in the cover, the second auxiliary switch compartment having a base, a first mounting channel and a second mounting channel mounted substantially perpendicularly to a first end of the base of the second auxiliary switch compartment, the first mounting channel of the second auxiliary switch compartment having a U-shaped opening facing a U-shaped opening in the second mounting channel of the second auxiliary switch compartment, the circuit breaker assembly further comprising a second wall-like mounting rail slidable within the U-shaped opening of the first mounting channel of the second auxiliary switch compartment and the U-shaped opening of the second mounting channel of the second auxiliary switch compartment, the second mounting rail including a second rail opening, a second auxiliary switch having a bottom surface, a front surface, and a rear surface, the rear surface of the second auxiliary switch having a projection passable through the second rail opening and slidable anywhere along the second rail opening.

18. The circuit breaker assembly of claim 17 wherein the rear surface of the second auxiliary switch includes a top end and a bottom end, and wherein a distance from the projection of the second auxiliary switch to the bottom end of the second auxiliary switch is greater than a distance from the projection of the first auxiliary switch to the bottom end of the first auxiliary switch.

* * * * *